United States Patent [19]

Taylor

[11] 3,935,327

[45] Jan. 27, 1976

[54] COPYING USING PYROELECTRIC FILM

[75] Inventor: Allen L. Taylor, Woodbury Township, Washington County, Minn.

[73] Assignee: Minnesota Mining and Manufacturing Company, St. Paul, Minn.

[22] Filed: Aug. 6, 1973

[21] Appl. No.: 385,848

[52] U.S. Cl. ..... 427/19; 427/22; 250/316; 346/1; 346/74 ES; 346/76 R; 96/1 C; 96/1.5; 427/24

[51] Int. Cl. ... G03g 5/00; G03g 13/08; G03g 13/10

[58] Field of Search..... 117/17.5, 37 LE; 96/1 R, 96/1 LY, 1 C; 317/262 F; 346/76 R, 74 ES, 1; 307/88 ET; 250/316

[56] References Cited

UNITED STATES PATENTS

| | | | |
|---|---|---|---|
| 3,276,031 | 9/1966 | Gaynor | 307/88 ET |
| 3,364,020 | 1/1968 | Fehlberg et al. | 307/88 ET |
| 3,519,461 | 7/1970 | Stowell | 117/17.5 |
| 3,607,754 | 9/1971 | Asahina et al. | 307/88 ET |
| 3,641,346 | 2/1972 | Lachambre | 250/83.3 H |
| 3,660,736 | 5/1972 | Igarashi et al. | 317/262 F |
| 3,672,981 | 6/1972 | Sloan et al. | 117/17.5 |
| 3,713,822 | 1/1973 | Kiess | 96/1 C |
| 3,752,667 | 8/1973 | D'Onofrio | 346/76 R |
| 3,824,098 | 7/1974 | Bergman et al. | 96/1 C |

OTHER PUBLICATIONS

Journal of Applied Physics, Vol. 42, No. 13, Dec. 1971, pp. 5219–5222.

Journal of Applied Physics, Vol. 41, No. 11, Oct. 1970, pp. 4455–4459.

Bergman et al., *Applied Physics Letters*, Vol. 21, No. 10, Nov. 15, 1972.

*Primary Examiner*—Michael Sofocleous
*Attorney, Agent, or Firm*—Alexander, Sell, Steldt & Delahunt

[57] ABSTRACT

A method is disclosed for copying a graphic representation using a uniformly poled pyroelectric material.

The uniformly poled pyroelectric material is selectively heated to form a differential charge pattern on the material. The differentially charged material can be used with charged toner particles to form a copy of the graphic representation using techniques well known in the art.

3 Claims, 2 Drawing Figures

COPYING USING PYROELECTRIC FILM

BACKGROUND OF THE INVENTION

In one aspect this invention relates to pyroelectric materials. In a further aspect, this invention relates to pyroelectric polymeric film materials. In yet another aspect, this invention relates to a method for copying a graphic representation using uniformly poled pyroelectric materials.

It is well known that the dipoles of a pyroelectric material, e.g. polyvinylidene fluoride film, which is biaxially oriented by the method of production, can be permanently poled by heating the material above a dipole-orienting temperature and then cooling the material in the presence of the electric field, see Bergman et al, *Applied Physics Letters*, Vol. 18, No. 5, March 1, 1971, p. 203–204.

Also known is the use of a plurality of pyroelectric-photoconductive crystals on a supporting substrate to form copies. The crystals are heated then exposed to a light source through a pattern which selectively heats the crystals, forming a charge, and simultaneously the photoconductive effect selectively drains away the charge produced. When the light source is removed, a differential charge remains which will attract toner powder, see U.S. Pat. No. 3,713,822.

SUMMARY OF THE INVENTION

Briefly, it has been found that pyroelectric materials, such as polyvinylidene fluoride film can be used to form copies. After permanently poling the pyroelectric film charges are selectively induced on the surface of the poled pyroelectric film in accordance with a graphic pattern by selectively heating or cooling the film from ambient temperature. The charges induced on the selectively heated film attract oppositely charged toner particles to the film and the particles are further transferred to a sheet of paper by standard techniques.

BRIEF DESCRIPTION OF THE DRAWINGS

A further understanding may be had by referring to the accompanying drawing in which.

Normally the dipoles of a pyroelectric material are oriented in a random fashion. When the pyroelectric material is heated above its poling temperature and an electric field is applied, the dipoles will orient themselves. The degree of dipole orientation is a function of film temperature, time of application and applied field strength. To readily orient the dipoles in a pyroelectric material it is necessary to heat the material above its poling temperature. For example, in polyvinylidene fluoride dipole orientation is readily achieved when the material is heated above 90°C. and an electric field of about 4000 volts per millimeter of thickness for 15 minutes is applied. Increasing the temperature and/or the applied field will increase the poling until the film is saturated. Once the poled film is cooled below the poling temperature, the field may be removed and the dipoles are permanently oriented without further application of heat or temperature.

DESCRIPTION OF THE PREFERRED EMBODIMENTS

Figure 1:
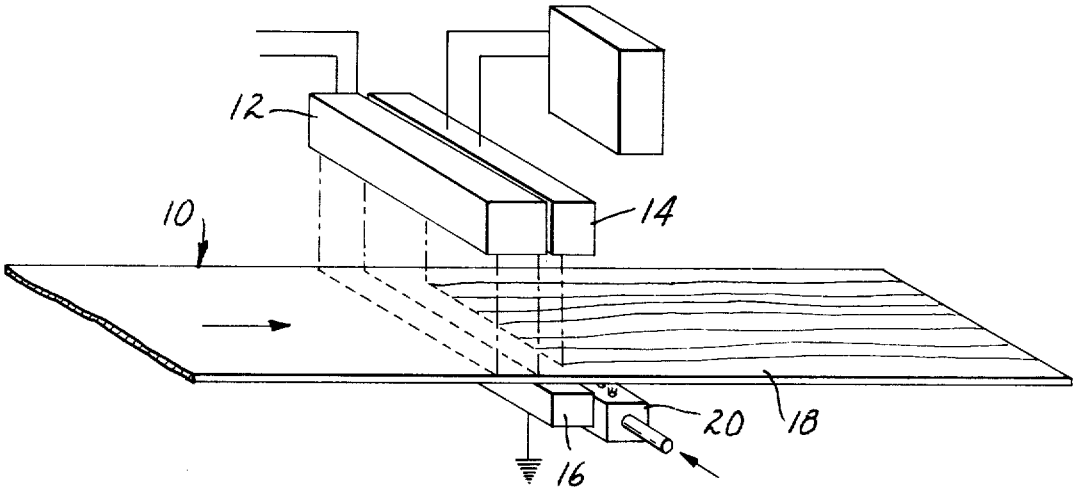
FIG. 1 is a perspective view of one apparatus useful in the practice of this invention for poling a pyroelectric material.

Referring to the drawing and initially to FIG. 1, a sheet of pyroelectric material, here a biaxially oriented polymeric film 10, such as polyvinylidene fluoride, is poled by heating above the critical poling temperature by heating means 12. While the sheet is still above the poling temperature it is moved into the electric field established between electrode 14 and ground electrode 16 and then the sheet is cooled to a temperature below its poling temperature as it moves past cooling means 20, for example, a cool air stream.

The electric field used to orient the heated film can be applied in a variety of ways, e.g. flat metal contacts, corona, pointed metal contacts. A constant direct current voltage is applied to the contacts while the pyroelectric film is passing between the contacts.

The pyroelectric polymeric materials to be poled can be heated by various means well-known in the art. Among the heating means contemplated by this invention are hot oil baths, warm air ovens, lamps, or electromagnetic radiation, etc., with the heat source being applied to a moving sheet or strip of the pyroelectric film.

The poled pyroelectric polymeric film can be used in making copies of a graphic representation. The poled film is subjected to a change in temperature corresponding to the graphic representation inducing a surface charge on the poled film in accordance with the graphic representation. One method of selectively heating the surface is by passing light from a lamp through a negative or other transparent media bearing a graphic representation. The charge induced on the film's surface is proportional to the change in temperature of the film's surface. The resulting charge pattern can be a continuously variable pattern depending on the manner in which the heat energy is applied and the graphic representation used. A variable charge pattern can also be produced by varying the application of heat energy from a source such as an electron beam, gamma radiation, etc. Since the pyroelectric film allows the formation of a continuously varying charge pattern, the resulting copy can have continuously variable gray tones.

After the desired variable charge pattern has been induced on the film's surface, the film is contacted with charged toner particles which will adhere to the oppositely charged portions of the film's surface. The amount of charged toner particles which will adhere to the film is dependent on the magnitude of the induced charge. Accordingly, the toner particle image will be darkest where there was the greatest incidence of energy.

The toner particles adhering to film can be transferred to a suitable substrate, e.g., a sheet of paper and the resulting image fused to the paper using techniques well known in the art.

For example, light passed through a color negative can be successively filtered using red, green and blue filters to form negative images and the resulting images toned using cyan, magenta, and yellow toner particles. The toned images are placed in registry and the images fused to form a colored copy.

Figure 2:
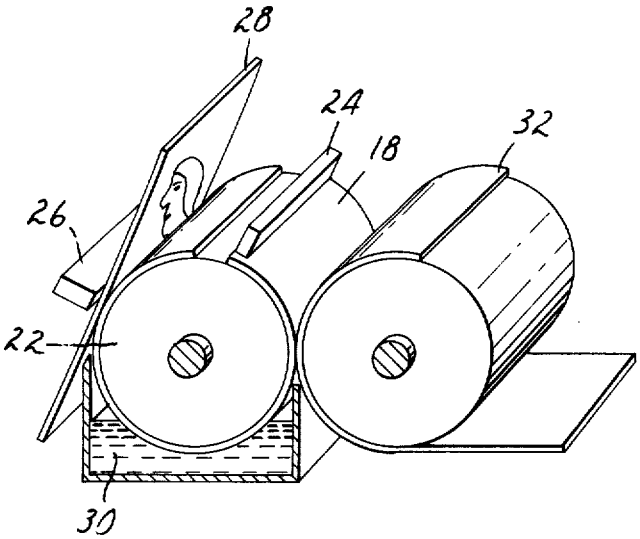
FIG. 2 is a perspective view of an apparatus used according to the method of this invention to copy an image using poled polymeric film.

The poled pyroelectric film 18 can be used as part of a copying mechanism, one example being the process of FIG. 2. The poled pyroelectric film 18 is attached to drum 22. As drum 22 is rotated counterclockwise, residual charges are removed from film 18 by a conductive brush static eliminator 24. The resulting neutralized film is selectively heated in accordance with a graphic representation 28, one heating means being light from lamp 26 passing through graphic representation 28. The heat forms a variable charge pattern on the exposed surface of the film in accordance with the graphic representation. The film with its graphic representation charge pattern is passed through a toner solution 30 containing charged particles. The charge pattern attracts oppositely charged toner particles. The particles are then transferred from sheet 18 to paper 32 and the resulting image fused to the paper using techniques well known in the art.

It is also possible to change the sign of the charge pattern on the pyroelectric film. If the selectively charged sheet is neutralized and then cooled the sign of the charge pattern will be reversed.

A further understanding may be had by reference to the following nonlimiting examples. It is to be understood that the invention is not limited to the illustrative embodiments set forth herein.

EXAMPLE 1

A biaxially oriented polyvinylidene fluoride film 10 cm. long by 10 cm. wide was poled by immersing the film in a 150°C. peanut oil bath between two copper sheet electrodes and cooling the oil, film and electrodes to 50°C. with a 3,000 volt electric field applied across the electrodes. On one surface of the poled film a thin aerosol coating of white spar varnish was applied and a conductive silver coating was sprayed over the varnish. The painted film material was attached to a cylindrical drum with the conductive silver coating contacting the drum's surface. The polymeric film surface was electrically neutralized using an alpha particle static eliminator. The silver film was grounded and a graphic representation was placed 1.27 cm. above the film's surface to form an assembly.

The assembly was then positioned for movement through a Dennison Graphofax toner solution forming a system like that shown in FIG. 2 and the graphic representation exposed to the radiation of a GE mercury-iodine lamp 12.5 cm. above the graphic representation for a period of two seconds. In regions where light struck the film, the surface became negatively charged, and the positive toner particles were attracted to the exposed film surface. The film was withdrawn from the solution and the image formed on the film by the toner particles was a negative of the graphic representation used.

The resulting image could be fused to the film's surface or transferred to another surface by methods well known in the copying art.

EXAMPLE 2

A poled sample of polyvinylidene fluoride film 7 cm. in diameter by 0.005 cm. thick was spray coated on one side with silver paint to form a continuous electrode and the electrode connected to ground. The film was placed on a 5 cm. diameter cylindrical tube with the electrode side exposed, as shown in FIG. 2 and the assembly placed for movement through a "Graph-O-Fax", a trademarked product of Dennison Co., liquid suspension containing charged toner particles. A pattern was cut out of black paper and light from a microscope lamp was allowed to pass through the pattern's openings and strike the electrode. Where the light struck, the sample was heated to about 30°C. above RT producing a negative charge on the electrode which attracted the positive toner particles.

The resulting image was transferred from the film to paper and the toner fused on the paper by heat.

EXAMPLE 3

A uniformly poled polyvinylidene fluoride sample 8 cm. in diameter and 0.005 cm. thick was coated on one side with a gold electrode and attached to a metal plate using silicone grease. The side with the gold electrode was toward the metal plate and was grounded. A light pattern was focused on the film. The lighted areas were heated about 30°C. above room temperature and the sample neutralized while using a "Pluton", a trademarked product of 3M Company, conductive brush.

The sample was cooled and coated with a charged powder using a grounded magne-dynamic roller. The roller is a conductive cylinder which contains discrete magnets. The magnets hold magnetic-charged toner particles on the roller before it is passed over the charged film. As the roller is passed over the film the electrostatic charge on the film is sufficient to remove the particles from the roller. Toner particles were attracted to the formerly heated areas forming a pattern in accordance with the focused light pattern. The toner particle pattern was transferred from the film to a sheet of paper using a roller.

EXAMPLE 4

A sample of ceramic lead zirconate-titanate 2 cm. in diameter by 0.05 cm. thick was heated to 300°C. and a field of 4000 V applied across the sample. The ceramic was cooled to room temperature with the field applied. A silver electrode was painted on one face of the poled sample and the electrode connected to ground. An area of the sample's face opposite the electrode was exposed to a focused beam of light which preferentially heated the sample 50°C. in the area struck by the light. Before cooling, the charge developed was neutralized using a conductive brush and the sample cooled.

The cooled sample was placed in a liquid toner suspension ("Graph-O-Fax"), with the silver electrode connected to ground. The areas which had been heated above the sample's ambient temperature attracted the positively charged toner particles.

EXAMPLE 5

A graphic representation was formed on a sheet of "Mylar" film using a black felt tip pen. Certain areas were made very dark black while other areas were coated lightly to provide varying shades of gray and some areas were left clear.

The procedure of Example 1 was repeated using the graphic representation as a pattern.

The procedure produced a faithful negative of the graphic representation; therefore, a copy with gray tones can be produced.

I claim:

1. A method for forming a copy of a graphic representation using a uniformly poled pyroelectric polymeric film comprising the steps of:

a. exposing said uniformly poled pyroelectric polymeric film to a heat source in accordance with the graphic representation to heat said film, thereby forming a charge pattern on said film in accordance with the graphic representation;

b. contacting said film bearing said charge pattern with toner particles charged so as to be deposited in accordance with the charge pattern on said film;

c. placing a sheet of a suitable substrate in registry on said film bearing said toner particle developed image to transfer said toner from said material to said substrate; and d. fusing said toner to said substrate, thereby forming a completed copy of the graphic representation.

2. The method according to claim 1 where said film is polyvinylidene fluoride.

3. The method according to claim 2 where said film is heated to a poling temperature of about 100°–150°C.

* * * * *